US008123469B2

(12) United States Patent
Andrei

(10) Patent No.: US 8,123,469 B2
(45) Date of Patent: Feb. 28, 2012

(54) HYDRAULIC PUMP COMPRISING A PREFILTER BODY IN TWO PORTIONS WHICH MAY BE ORIENTED IN ROTATION

(75) Inventor: Gerard Andrei, Saint Cyr sur Mer (FR)

(73) Assignee: Gatech, Gemenos (FR)

( * ) Notice: Subject to any disclaimer, the term of this patent is extended or adjusted under 35 U.S.C. 154(b) by 652 days.

(21) Appl. No.: 12/337,733

(22) Filed: Dec. 18, 2008

(65) Prior Publication Data

US 2009/0145828 A1 Jun. 11, 2009

Related U.S. Application Data

(60) Provisional application No. 61/015,526, filed on Dec. 20, 2007.

(30) Foreign Application Priority Data

Dec. 7, 2007 (FR) ..... 07 59635

(51) Int. Cl.

| | |
|---|---|
| ***F03B 11/00*** | (2006.01) |
| ***F04D 11/08*** | (2006.01) |
| ***F04D 29/44*** | (2006.01) |
| ***F04D 29/54*** | (2006.01) |
| ***F01D 29/00*** | (2006.01) |

(52) U.S. Cl. ..... 415/121.2; 415/126; 415/206; 415/211.2

(58) Field of Classification Search ..... 415/126, 415/127, 206, 211.2, 214.1, 121.2; 417/1, 417/18, 44.4, 40, 298, 296, 423.11, 423.1, 417/142, 138

See application file for complete search history.

(56) References Cited

FOREIGN PATENT DOCUMENTS

| | | |
|---|---|---|
| AU | 447909 | 4/1974 |
| DE | 20107470 | 8/2001 |
| EP | 1186782 | 3/2002 |
| EP | 1267085 | 12/2002 |

*Primary Examiner* — Chuong A. Luu

(74) *Attorney, Agent, or Firm* — Lucas & Mercanti, LLP

(57) ABSTRACT

The present invention relates to a hydraulic pump (10) hydraulic portion body (1) capable of cooperating with a pump electric motor body (1*c*), said hydraulic portion body (1) including a pre-filter body (1*a*) comprising:

Figure 1:
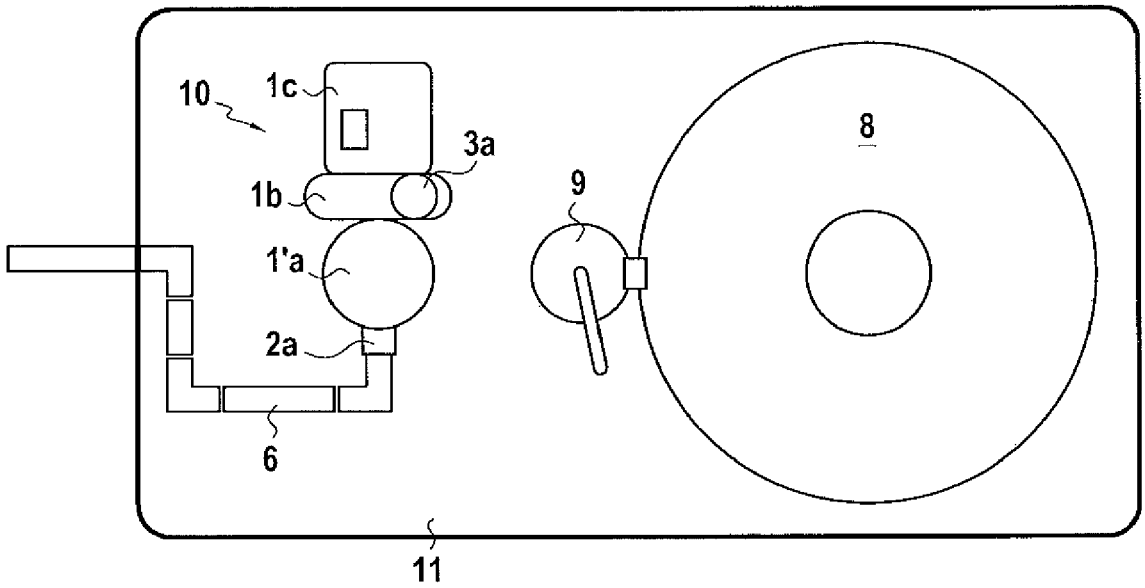

an upper portion (2), and a lower portion (3), and said upper portion (2) and lower portion (3) of said pre-filter body being independent of each other and mounted in a sealed (6*a*) removable attachment (6*b*, 6*c*), the orientation of both of said upper portions (2) and lower portion (3) of the pre-filter body relatively to each other being adjustable in rotation relatively to each other according to several positions, preferably in at least 3 different positions, still preferably at least 4 different positions, still preferably according to any position.

16 Claims, 8 Drawing Sheets

HYDRAULIC PUMP COMPRISING A PREFILTER BODY IN TWO PORTIONS WHICH MAY BE ORIENTED IN ROTATION

This application claims the benefit of priority of French Application No. 07-59635, filed Dec. 7, 2007, and U.S. Application No. 61/015,526, filed Dec. 20, 2007, the entire content of both applications are hereby incorporated by reference.

The present invention relates to the field of hydraulic pumps for swimming pools.

More particularly, the present invention relates to a hydraulic portion body of a pumping and pre-filtration device or pump, said hydraulic portion body being capable of cooperating with a pump electric motor body, said hydraulic portion body including a pre-filter body comprising a suction orifice capable of cooperating with a rigid water inlet pipe from a swimming pool, said pre-filter body comprising or being able to cooperate with a turbine casing body comprising a discharge orifice able to discharge water towards the swimming pool, preferably via a sand filter or another water treatment accessory, for example of the NCC type, when said turbine is driven into rotation by an electric motor cooperating with said casing body.

It is understood that the turbine casing body contains the turbine as a vane or paddle, mounted so as to axially rotate in the turbine casing body. When the turbine casing body is mounted in attachment with the electric motor, the turbine is encased in a body which comprises pressurized water when the electric motor is actuated, whereas the pre-filter body itself is relatively depressurized. Therefore water enters the pre-filter body through said suction orifice, passes through a filtration system inside the pre-filter body, notably of the pan type, before arriving into the turbine casing body, in order to be discharged through said discharge orifice towards the sand filter or another water treatment accessory.

The installation of the pump and its connection to the water inlet circuit of the swimming pool on the one hand, and to a pipe for feeding the sand filter on the other hand, are one of the phases which are sometimes long and delicate. It is notably, sometimes necessary to provide many bends in order to have the inlet pipe for water from the swimming pool from the surface suction skimmer or from the waste plug or other water suction devices of the swimming pool coincide with the suction orifice, which, sometimes, not only poses problems of bulkiness, but additionally affects the yield of the pump. Indeed, the multiplicity of the bends inevitably induces pressure losses.

In order to solve this problem, the present invention provides a pump hydraulic portion body comprising a pre-filter body characterized in that said pre-filter body comprises:

- an upper portion comprising a wall comprising said suction orifice, and a second large lower orifice, and
- a lower portion comprising a peripheral wall comprising a third large upper orifice communicating with said second large lower orifice, preferably of the same circular dimension as the latter, and a side orifice communicating or being able to laterally communicate with said turbine casing body, and
- said upper portion and lower portion of said pre-filter body are independent of each other and mounted in a removable sealed attachment at the peripheral edges of said second and third large orifices, preferably of the same circular sections, so that they coincide against each other by attachment, the orientation of both said upper portions and lower portion of the pre-filter body relatively to each other being adjustable in rotation with respect to each other according to several positions, preferably in at least 3 different positions, still preferably at least 4 different positions, still preferably according to any position.

It is understood that this is a rotation relatively to an axis perpendicular to the virtual or real connecting plane of said second and third large orifices, the latter being able to have peripheral edges of the same shape or of a complementary shape.

Thus, it is possible to change the orientation of said suction orifice in order to facilitate connection of the latter with said water inlet pipe from a swimming pool when the discharge orifice is connected with a pipe leading the water towards the sand filter.

With the present invention it is therefore possible to increase the flow rate of the pump and reduce the time for installing the pump, by reducing the costs of possible necessities for bringing the rigid water inlet pipe to the suction orifice of the pre-filter body.

More particularly, the hydraulic pipe portion body according to the present invention comprises a so-called pre-filter body capable of containing a filtration pan and comprising a first large upper orifice capable of allowing said pan of said pre-filter body to be extracted, said first large upper pan outlet orifice being removably and sealably covered by a removable lid characterized in that said pre-filter body comprises:

- a so-called upper portion comprising a wall including said suction orifice, said first large upper pan outlet orifice and said lid, and a second large lower orifice comprising a peripheral edge, and
- a so-called lower portion comprising a receptacle capable of containing said pan, a receptacle, the peripheral wall of which comprises at its upper end, a third large upper orifice comprising a peripheral edge of the same flat and circular shape as that of said peripheral edge of said second large lower orifice capable of letting through said pan for extracting or introducing it into said pre-filter body, and
- said upper portion and lower portion of said pre-filter body are mounted in an attachment in a connecting plane at the circular peripheral edges of said second and third large orifices, which fit against each other, said attachment of both of said peripheral edges being able to be oriented in rotation in said connecting plane in a variable way relatively to each other according to one of said positions.

It is understood that this is a rotation relatively to an axis perpendicular to said actual connecting plane of said second and third large orifices, at peripheral edges of the same shape.

In a first alternative embodiment, said pre-filter body is independent of said turbine casing body with which it is able to cooperate in a removable attachment.

More particularly, in this first alternative embodiment, said peripheral wall of the receptacle of the lower portion comprises a side orifice able to cooperate in a removable attachment with a corresponding side orifice of a so-called turbine casing body, preferably said side orifices each comprising a peripheral edge which will abut against each other, preferably at the end and respectively inside both tubular end pieces, sleeve-coupled into each other.

In a second alternative embodiment, said lower portion of the pre-filter body forms a one-piece body with said casing body with which it communicates at said peripheral wall of the receptacle of said lower portion.

According to a particular feature of the invention in both of these alternative embodiments, said turbine casing body includes a connecting flange able to cooperate with a matching connecting flange of an electric motor body of the pump.

Advantageously, the junction between said upper portion and lower portion comprises between said peripheral edges of said second and third large lower and respectively upper orifices, a circular O-ring.

Still advantageously, the attachment between said upper portion and lower portion, at said peripheral edges of said second and third large lower and upper orifices, is achieved by two clamping half-collars, the ends of which are attached against each other, preferably by screwing.

In another embodiment, the attachment between said upper portion and lower portion, at said peripheral edges of said second and third large lower and upper orifices, is achieved by screwing with a threaded clamping bracket cooperating with a peripheral outer thread of the peripheral edge of said third large upper orifice, and the orientation of both of said upper portion and lower portion of the pre-filter body relatively to each other, is adjustable in rotation relatively to each other according to any position.

In another embodiment, said attachment between said upper portion and lower portion, at said peripheral edges of said second and third large lower and upper orifices, is accomplished by a plurality of bolts and screws cooperating with a plurality of orifices regularly distributed in said peripheral edges of said second and third large orifices.

More particularly, said orifices are small circular orifices able to receive a so-called screw and the orientation of one of both said upper portion and lower portion of the pre-filter body relatively to the other portion, being adjustable in rotation according to a limited number of positions, preferably in at least 3 different positions, still preferably at least 4 different positions, still preferably at least 12 positions, corresponding to the number of said small orifices in each said peripheral edge. The passing from one position to the other is accomplished by rotatably shifting one of both said upper portion and lower portion of the pre-filter body relatively to each other by an angle equal to a multiple of the angle between both said small consecutive orifices.

According to another alternative, said orifices are slots extending along a circular arc direction over a portion of said circular peripheral edges, said slots extending over an angular sector. It is understood that the orientation of one of both said upper portion and lower portion of said pre-filter body relatively to each other is rotatably adjustable by an angular shift of said upper portion or lower portion relatively to the other one, the screws remaining in the same slots, or by a shift implying that said screws occupy different slots before and after shifting of said upper portion or lower portion. By applying these slots, it is therefore possible to perform a more accurate and finer adjustment of the orientation of both of said upper and lower portions relatively to each other.

More particularly, the hydraulic portion body according to the invention comprises:

said upper portion comprises a tubular wall with a section at least partly circular, opening out at its upper and lower ends on said first upper large orifice and said second lower large orifice, said lower portion comprises a tubular peripheral wall, with a same at least partly circular section, the upper end of which opens out onto said third large upper orifice, the lower end of said tubular peripheral wall of said receptacle corresponding to the bottom of said receptacle.

Preferably, said upper portion comprises a tubular wall with a partly circular section, comprising two diametrically opposite flats at the attachment components of said lid. It is understood that both flats are joined by two circular arcs.

With this embodiment, the discharge orifice may be brought closer to the turbine casing body without attachment components of the lid hitting it when said lid is rotatably shifted with said attachment components facing said discharge orifice.

The present invention also provides a swimming pool pumping and pre-filtration device comprising an electric motor mounted in a removable attachment with a so-called turbine casing body cooperating with a pump hydraulic portion body according to the invention, or forming a same one-piece body with a pump hydraulic portion body according to the invention, notably with said lower portion of the pump hydraulic portion body according to the invention.

Figure 2:
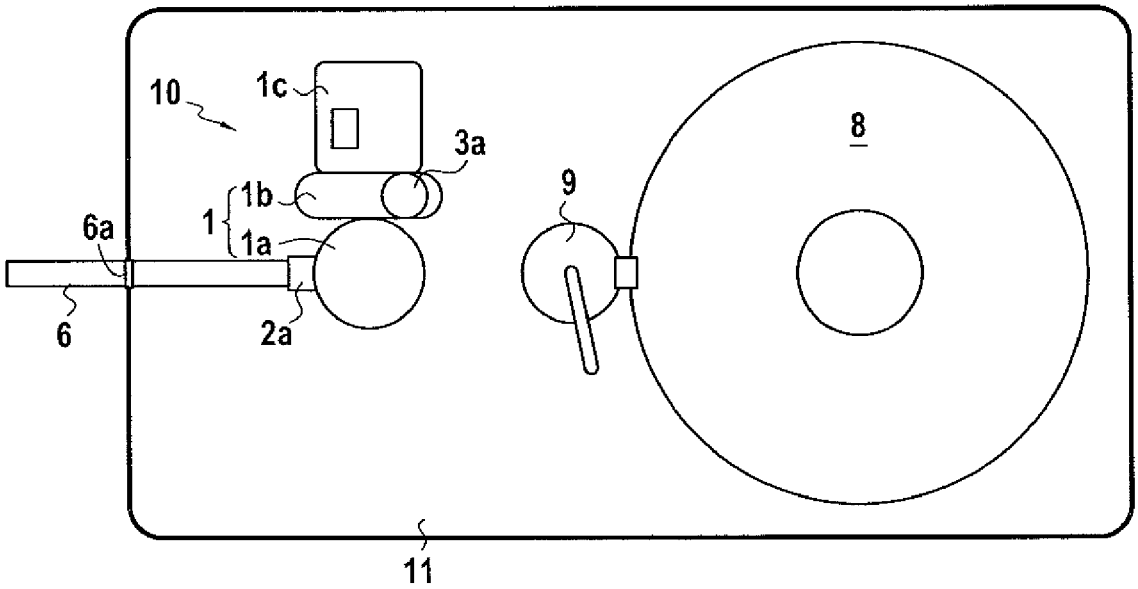
Figure 3:
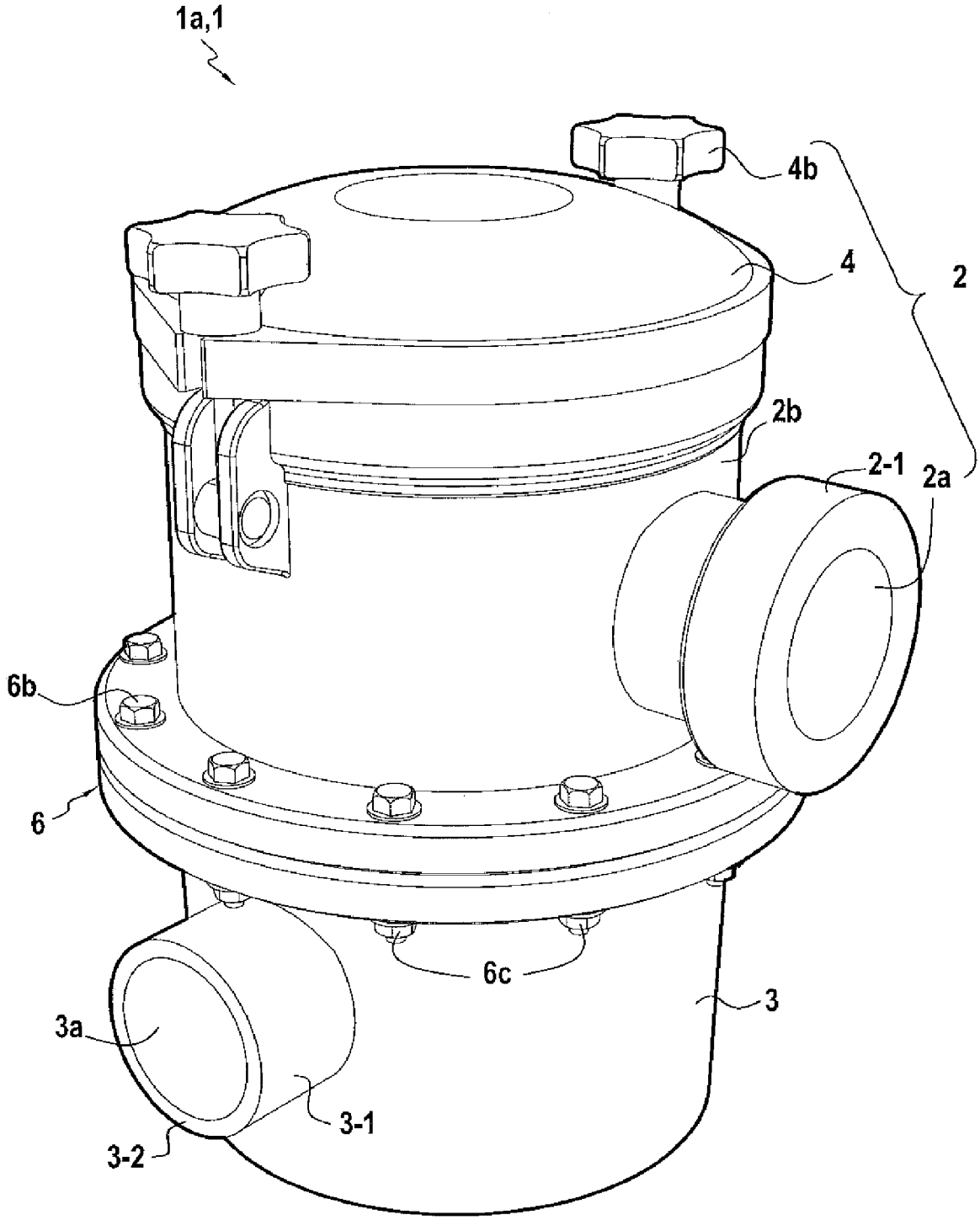
Figure 4:
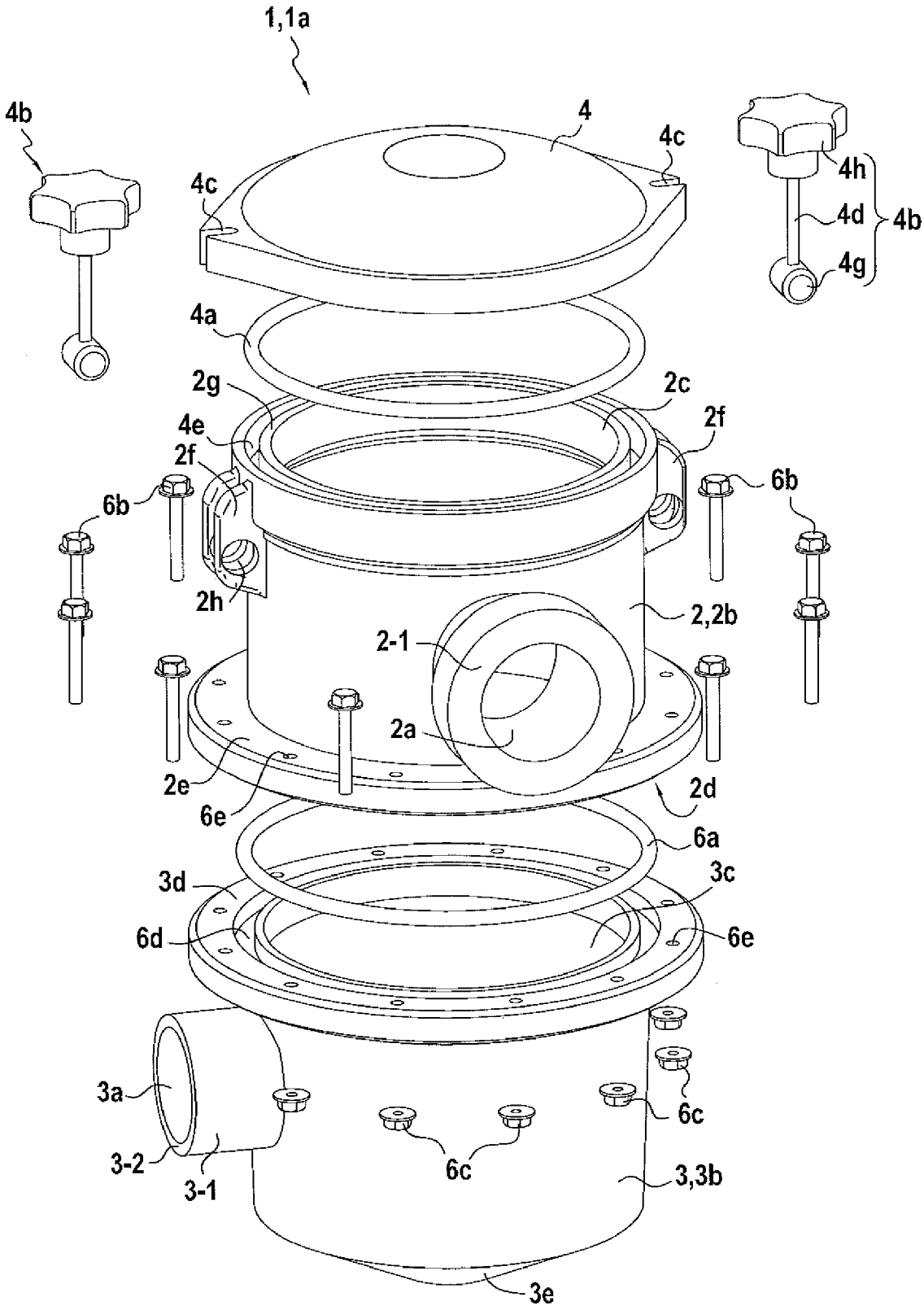
Figure 5:
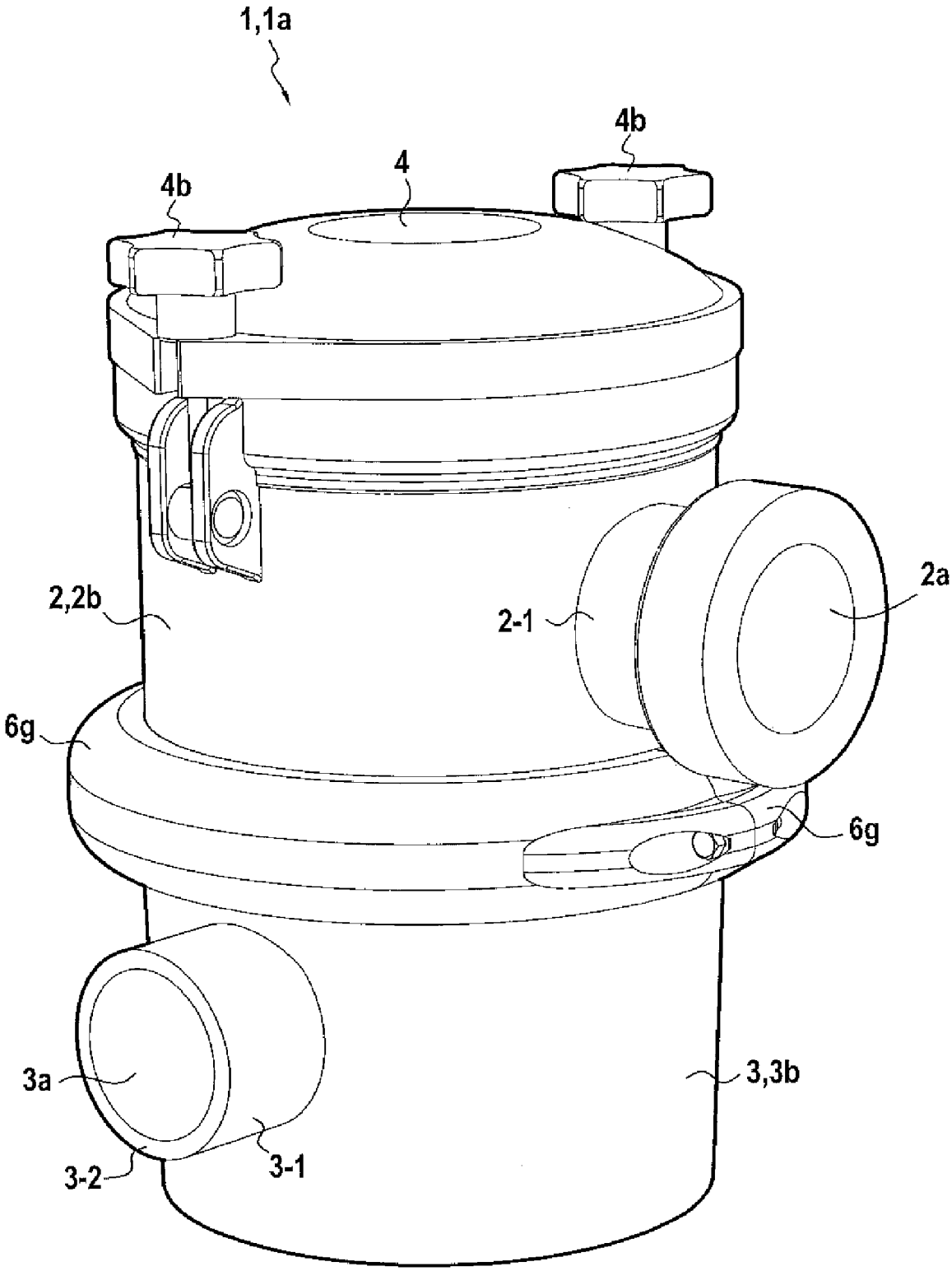
Figure 6:
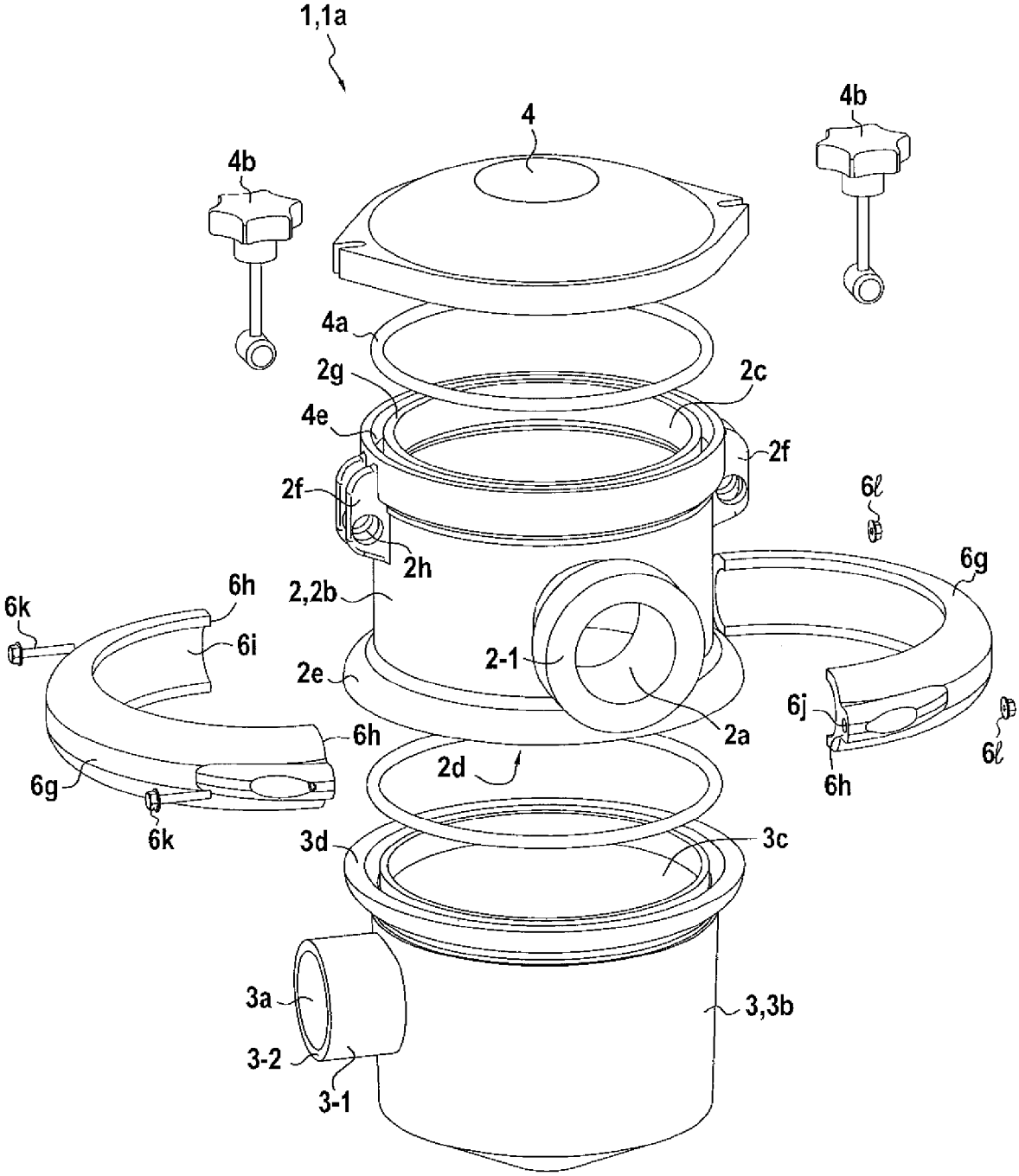

Other features and advantages of the present invention will become better apparent upon reading the following description, made in an illustrative and non-limiting way, with reference to the appended figures wherein:

FIG. 1 illustrates as a top view, a mounting diagram for a pump with a one-piece pre-filter body according to the prior art, FIG. 2 illustrates a mounting diagram for a pump according to the invention, comprising a pre-filter body in two portions, for which it has been possible to change the adjustment in rotation of the upper pump portion, so as to change the orientation of the suction orifice in order to facilitate connection of the water inlet pipe with the pump without any bend, FIGS. 3 and 4 illustrate a first alternative of a pre-filter body according to the invention, as a side view (FIG. 3) and as an exploded view (FIG. 4), with clamping collars, FIGS. 5 and 6 are a side view (FIG. 5) and an exploded view (FIG. 6) of a second embodiment of a pre-filter body according to the present invention, wherein said upper and lower portions are attached to each other by a plurality of screws and bolts.

Figure 8:
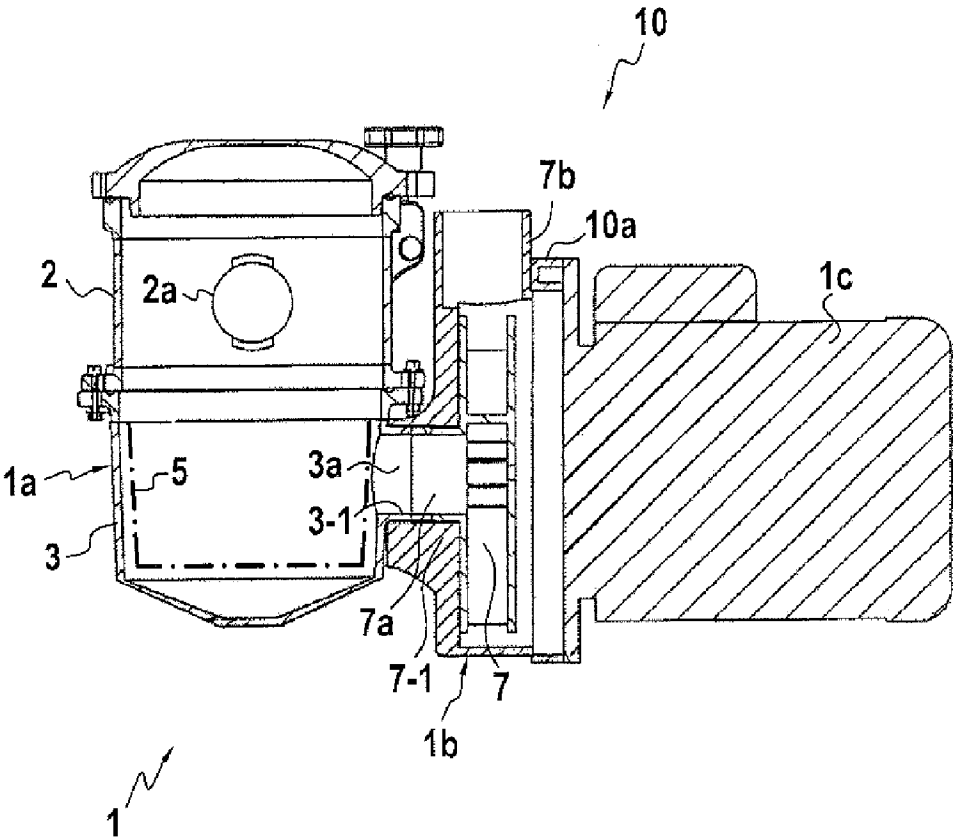
Figure 7:
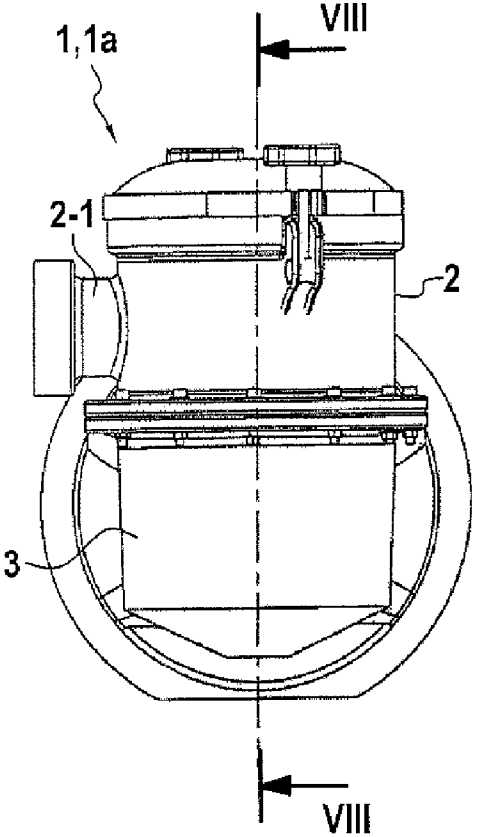
Figure 9:
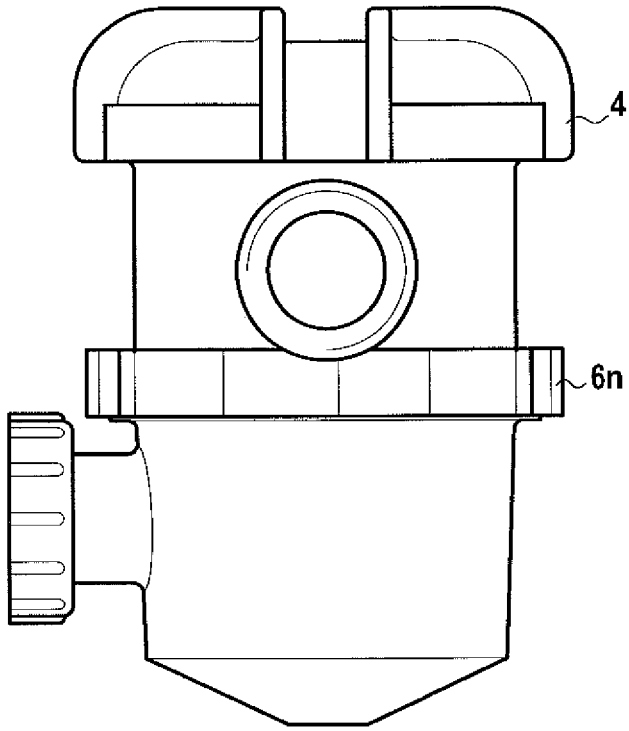
Figure 10:
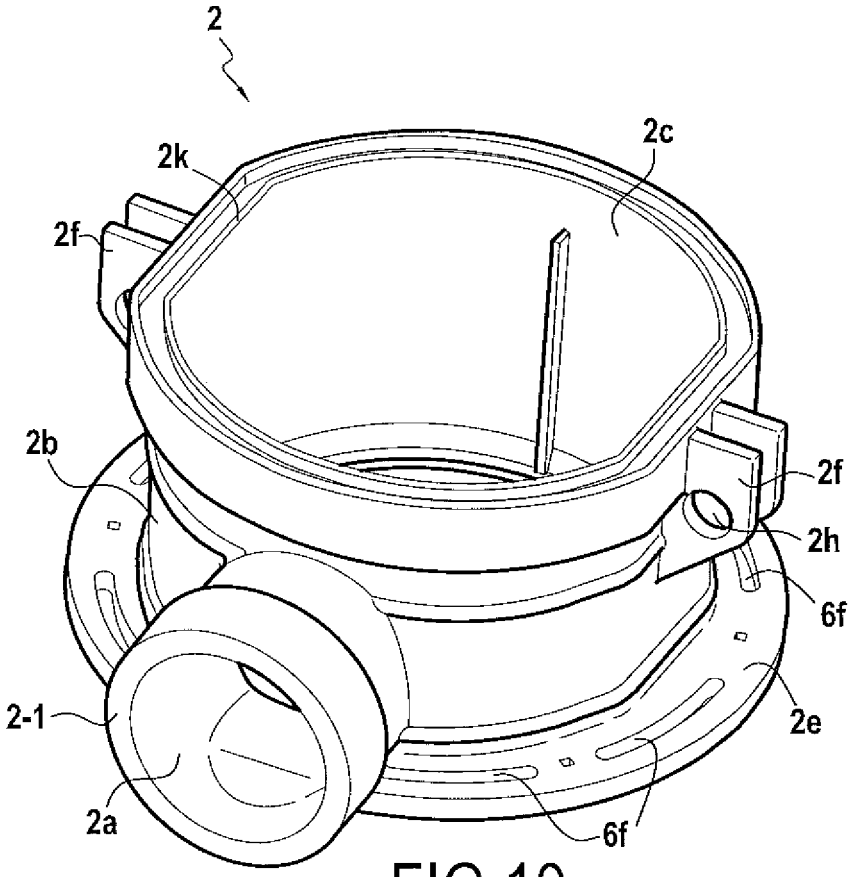
Figure 11:
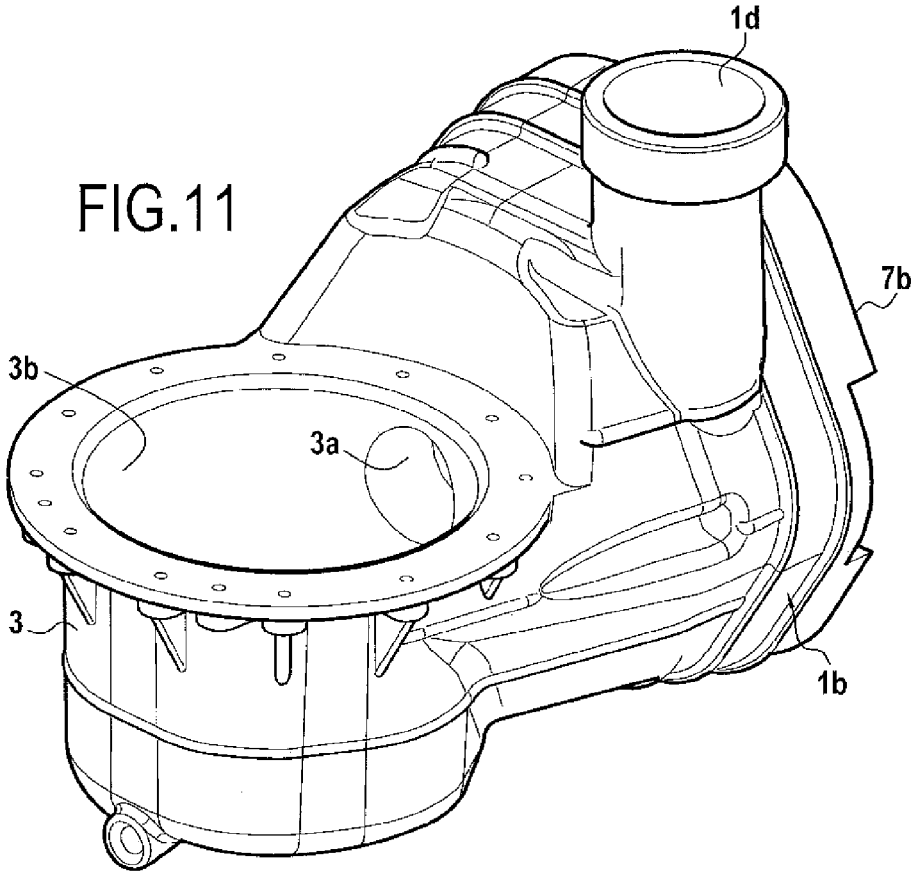
Figure 12:
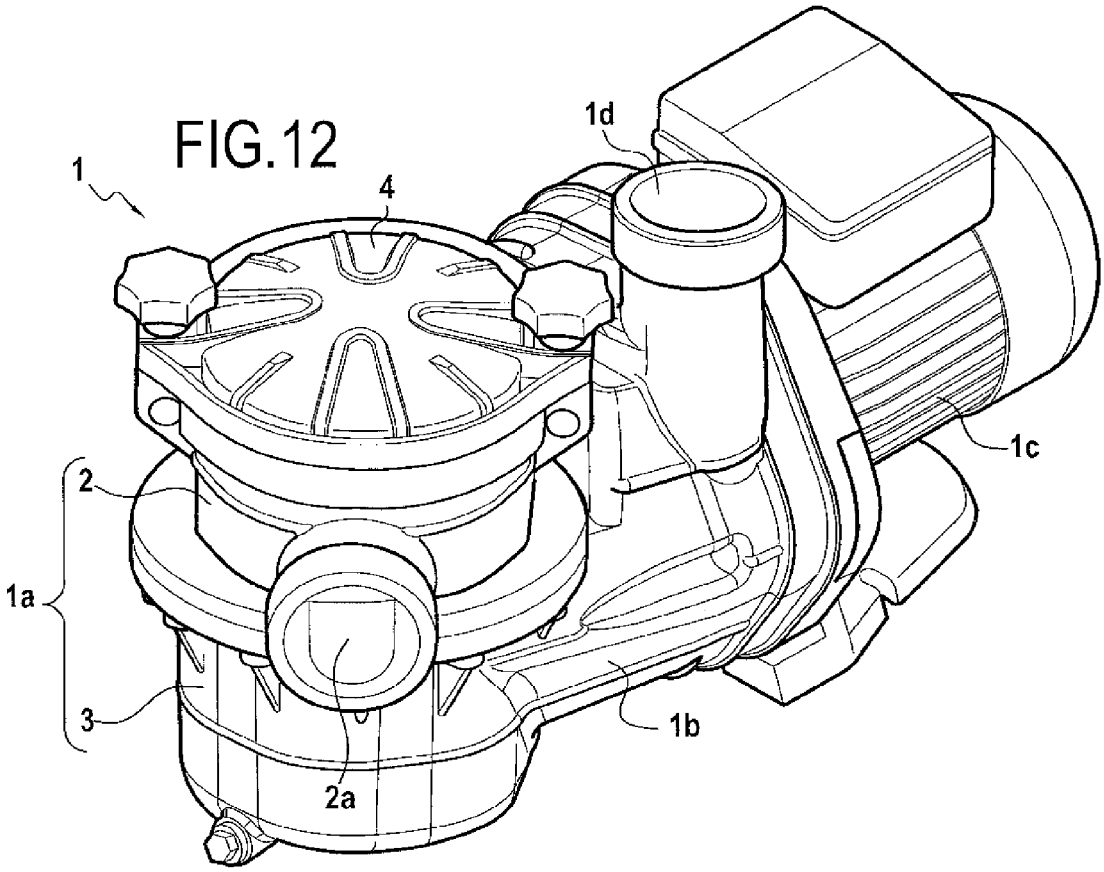

FIGS. 7 and 8 are side and partial sectional views of a pre-filtration and pumping device 10 according to the invention, FIG. 9 is a side view of another embodiment, wherein the upper and lower portions are attached to each other by clamping, FIG. 10 illustrates an alternative embodiment of the shape of the upper portion 2, FIG. 11 illustrates a one-piece body between the lower portion of the hydraulic portion body and the turbine casing body, FIG. 12 illustrates a view of a complete pump with the electric motor attached on the turbine casing body of FIG. 11.

In FIGS. 1 and 2, top views of different components of a pumping and filtration installation in an equipment room 11 are illustrated, comprising:

a sand filter 8 provided with a 6-way valve 9, a inlet conduit 6 for water from the swimming pool, and a pumping and pre-filtration installation 10 upstream from the sand filter 8.

In FIG. 1, the pumping and pre-filtration installation 10 comprises:

a—a pre-filter body according to the prior art 1'*a*, comprising an orifice 2*a* for sucking up water from the duct 6, this pre-filter body 1'*a* being a one-piece body, the suction orifice 2*a* being removably positioned in the general axis of the installation (axis of the turbine and axis of the motor 1*c*), b—a turbine casing body 1*b* comprising a discharge orifice 1*d*, discharging the water in a conduit (not shown) towards the sand filter 8, and c—an electric motor body 1*c* actuating the turbine inside the turbine casing body 1*b*.

The assembly of the pre-filter body 1'*a* and of the turbine casing body 1*b* forms what is called the hydraulic portion body of the installation 10.

In FIG. 2, an installation similar to the one of FIG. 1 is illustrated, with the difference that a pre-filter body 1*a* according to the present invention has been implemented, so that the end-piece corresponding to the suction orifice 2*a* of the pre-filter body has been pivoted by 90° with respect to a vertical axis of the pre-filter body. With this, it was possible to reach the inlet point 6*a* of the water conduit 6 in the equipment room, without any bend, which represents a gain in time for placing the pumping and pre-filtration installation and a gain in flow rate or yield during operation.

In the embodiment of FIGS. 3-6, the pre-filter body 1*a* is independent of the turbine casing body 1*b*, with which it is able to cooperate in a removable attachment, as this will be described hereafter.

In FIGS. 3 and 4, a first alternative embodiment of a pre-filter body as described hereafter is illustrated.

In FIGS. 3-6, the pre-filter body 1*a* comprises a lower portion 3, which comprises a tubular peripheral wall 3*b* with a circular section, the upper end of which delimits a large upper orifice 3*c* designated as "third large upper orifice 3*c*", and the lower end of which is closed by a bottom 3*e* in order to form a receptacle of a filtration pan 5. The tubular wall 3*b* comprises a side orifice 3*a* formed by a tubular end-piece 3-1. This side end-piece 3-1 forming an orifice 3*a* is able to cooperate in a removable attachment with a side orifice corresponding to the turbine casing body 1*b* at its respective peripheral edge 3-2.

The third large upper orifice 3*c* of said lower portion 3 comprises a peripheral edge 3*d* with a circular groove 6*d* on its upper face, in which an elastomeric O-ring 6*a* may be accommodated. Outside the groove 6*d* and the O-ring 6*a*, a plurality (12) of perforations 6*a* are positioned regularly spaced apart from each other, with which said lower portion 3 and an upper portion 2 of the pre-filter body may be attached to each other as this is described hereafter, by means of screws 6*b* and bolts 6*c*.

The upper portion 2 of the pre-filter body comprises a tubular wall with a circular section 2*b* comprising a side end piece 2-1 forming a suction orifice 2*a* and delimiting at its upper and lower ends of the first large upper orifice 2*c* and the second large lower orifice 2*d* respectively.

Said second large lower orifice 2*d* is surrounded by a peripheral edge 2*e* of the same flat and circular shape as the peripheral edge 3*d* of said third large upper orifice 3*c* of the lower portion 3. These peripheral edges 2*e* and 3*d* also comprise a same number of perforations 6*e*.

The three said first, second and third large orifices have the same diameter so that it is possible to introduce or extract the pan 5 from the top, when the lid 4 is opened as this will be discussed later on.

Said upper portion 2 and lower portion 3 of said pre-filter body are mounted in an attachment in a connecting plane 6 at the first peripheral edges 2*e*, 3*d*, of said second and third large orifices 2*d*, 3*c*, so that said peripheral edges of said second large lower orifice 2*a* and third large upper orifice 3*c* fit against each other, said attachment of both of said upper portion 2 and lower portion 3 of the pre-filter body at both of said peripheral edges 2*e*, 3*d*, being able to be oriented in rotation in said connecting plane 6, in a variable way relatively to the each other, by an angular shift of 30°, i.e. according to 12 different positions, according to the orientation intended for the suction orifice 2*a* according to the inlet position 6*a* in the equipment room of the water flow duct 6.

The first large upper orifice 2*c* of the upper portion 2 comprises a peripheral edge 2*g*, with a circular groove 4*e* on its upper outer face in which an elastomeric O-ring gasket 4*a* may be accommodated providing the seal with the lid 4.

The tubular peripheral wall 2*b* comprises two diametrically opposite outer yokes 2*f* for attaching the lid 4. The lid 4 also comprises two diametrically opposite side notches 4*c*. The notches 4*c* and yokes 2*f* allow the lid 4 to be sealably and removably attached onto the peripheral edge 2*g* of the first large upper orifice 2*c*, by means of screws 4*b* equipped with small tubular attachment blocks 4*g*. These blocks 4*g* comprise a perforation with a thread, so that by screwing the threaded rod 4*d* of the fixing screws 4*d* when the small tubular 4*g* is inserted in perforations 2*h* extending transversely through both branches forming the yoke 2*f*, it is possible to attach the lid 4 by clamping against the peripheral edge 2*g* of the upper portion 2 of the pre-filter body when the fixing screws 4*b* are accommodated in the notches 4*c* of the lid, and then the threaded rod 4*d* of the screws 4*b* is screwed into the perforation of the first tubular block 4*g* by means of the knobs 4*h* of the screws 4*b* retained by the notches 4*c*.

The embodiment of FIGS. 5 and 6 differs from that of FIGS. 3 and 4 by the attachment method of said upper portion 2 and lower portion 3. In FIGS. 5 and 6, two half-collars 6*g*, the ends of which 6*h* are diametrically opposite, are applied, i.e. each half-collar covers a half circle. On the inner face of each half-collar, a groove 6*i* allows the peripheral edges 2*e* and 3*d* of said second large lower orifice 2*d* and third large upper orifice 3*c* to be blocked against each other, which will lodge themselves in said groove 6*i*, when both of the half-clamping collars 6*g* are clamped against each other. The ends 6*h* placed end-to-end of each half-collar include a perforation 6*j*, in which screws 6*k* may be inserted in a perforation 6*j* of a first half-collar cooperating with bolts 6*l* on the outside of the perforation 6*j* of the second half-collar.

In FIGS. 7 and 8, a pre-filtration and pumping device 10 is illustrated with a pre-filter body 1*a* cooperating with a turbine casing body 1*b* containing a turbine 7 comprising paddles with vanes or fins, cooperating with an electric motor 1*c* so as to be able to drive it into rotation. The lower portion 3 of the pre-filter body includes a communicating orifice 3*a* which communicates with an orifice 7*a* of the turbine casing body. The side orifice 3*a* of the pre-filter body is formed by a tubular end-piece 3-1 which will fit inside the tubular orifice 7*a* of the turbine casing body. More specifically, the outer peripheral 3-2 of the tubular end-piece 3-1 will abut onto an inner peripheral edge of an inner abutment 7-1 of the side orifice 7*a* of the turbine casing body. Said turbine casing body 1*c* includes a connecting flange 7*b* able to cooperate with a matching connecting flange 10*a* of an electric motor 1*c* body of the pump 10.

In FIG. 9, a pre-filter body is illustrated, in which the lower portion 3 and upper portion 2 are attached to each other by means of a clamping bracket 6*n* containing on its inner face, a female thread able to cooperate with a male thread on the periphery of said third large upper orifice 3*c* of the lower portion 3, at the upper end of said lower portion 3. More specifically, the clamping bracket 6*n* will press against the peripheral edge 2*e* surrounding the second large lower orifice 2*d* of the upper portion 2, and the male threading cooperating with the inner female threading of said clamping bracket 6*n*, is made on the outer peripheral face of the peripheral edge 3*d* surrounding said third large upper orifice 3*c*.

Also, in FIG. 9, an embodiment is illustrated in which the lid 4 of the first large upper pan outlet orifice 2*c* is attached on said first large upper orifice 2*c* by clamping while having an inner female peripheral thread of said lid cooperates with an outer male peripheral thread around said first large upper orifice 2*c* of the pre-filter body 1*a*.

In FIG. 10, an advantageous alternative embodiment of the upper portion 2 of the pump hydraulic portion body is illustrated, in which the small orifices 6*e* of the edge 2*e* of the lower end of the tubular wall 2*b*, surrounding said second large lower orifice 2*d*, are replaced with slots 6*f* extending over a portion of said circular edge over a given angular sector.

It is understood that the peripheral edge 3*d*, surrounding said large upper orifice 3*c* of the lower portion 3 should include the same slots, in the same number, positioned so as to coincide with those of the peripheral edge 2*e* of the upper portion 2.

With this alternative embodiment, more accurate and finer angle adjustments may be performed, allowing the upper portion 2 to be shifted relatively to the lower portion, without having to move the screws 6*b* from one slot to the other of said peripheral edge 2*e* of the upper portion 2.

In FIG. 10, a tubular wall 2*b* is also illustrated, including a partial circular section with two diametrically opposite flats 2*k* at the attachment components 2*f* of the lid 4. This embodiment is advantageous because it provides reduction of the distance between the discharge orifice 1*d*, without the attachment components of the lid 2*f* abutting thereon when the upper portion 2 and the lid 4 are rotationally shifted with said attachment components 2*f* facing said discharge orifice 1*d* of the turbine casing body 1*b*.

In FIG. 11, an alternative embodiment of an hydraulic pump portion body is illustrated, for which the lower portion 3 of the pre-filter body forms a one-piece body with said turbine casing body 1*c* with which it communicates at the side orifice 3*a* of said peripheral wall 3*b* of the receptacle of the lower portion 3. The turbine casing body 1*b* contains the turbine 7 and the motor 1*c*, illustrated in FIG. 12, will press against the flange 7*b*.

The invention claimed is:

1. A pump hydraulic portion body capable of cooperating with a pump electric motor body, said hydraulic portion body including a pre-filter body comprising a suction orifice capable of cooperating with a rigid inlet pipe for water from a swimming pool, said pre-filter body comprising or being able to cooperate with a turbine casing body comprising a discharge orifice able to discharge the water towards the swimming pool when said turbine is driven into rotation by an electric motor cooperating with said casing body, characterized in that said pre-filter body comprises:

an upper portion comprising a wall comprising said suction orifice, and a second large lower orifice, and a lower portion comprising a side wall comprising a third large upper orifice communicating with said second large lower orifice and a side orifice communicating or being able to laterally communicate with said turbine casing body, and said upper portion and lower portion of said pre-filter body are independent of each other and mounted in a sealed removable attachment at the peripheral edges of said second and third large orifices, so that they coincide against each other by attachment, the orientation of both of said upper portions and lower portion of the pre-filter body relatively to each other being adjustable in rotation relatively to each other according to several positions.

2. The pump hydraulic portion body according to claim 1, said pre-filter body is capable of containing a filtration pan and comprising a first large upper orifice capable of allowing said pan to be extracted from said pre-filter body, said first large upper pan outlet orifice being removably and sealably covered by a removable lid characterized in that said pre-filter body comprises:

a said upper portion comprising a wall including said suction orifice, said first large upper outlet orifice of the pan and said lid, and a second large lower orifice comprising a peripheral edge, and a said lower portion comprising a receptacle capable of containing said pan, a receptacle for which the peripheral wall comprises at its upper end a third large upper orifice comprising a peripheral edge of a same flat and circular shape as that of said peripheral edge of said second large lower orifice capable of letting through said pan in order to extract it or introduce it into said pre-filter body, and said upper portion and lower portion of said pre-filter body being mounted in an attachment in a connecting plane at the peripheral edges of said second and third large orifices, which fit against each other, said attachment of both said circular peripheral edges being able to be oriented in rotation in said connecting plane in a variable way relatively to each other according to one of said positions.

3. The pump hydraulic portion body according to claim 1, characterized in that said pre-filter body is independent of said turbine casing body with which it is able to cooperate in a removable attachment.

4. The pump hydraulic portion body according to claim 2, characterized in that said peripheral wall of the receptacle of the lower portion comprises a side orifice capable of cooperating in a removable attachment with a corresponding side orifice of said turbine casing body.

5. The pump hydraulic portion body according to claim 1, characterized in that said lower portion of the pre-filter body forms a one-piece body with said casing body with which it communicates at said peripheral wall of the receptacle of said lower portion.

6. The pump hydraulic portion body according to claim 2, characterized in that the junction between said upper portion and lower portion comprises between said peripheral edges of said second and third large lower and respectively upper orifices a circular O-ring.

7. The pump hydraulic portion body according to claim 2, characterized in that the attachment between said upper portion and lower portion, at said peripheral edges of said second and third large lower and upper orifices, is achieved by two clamping half-collars, the ends of which are attached against each other.

8. The pump hydraulic portion body according to claim 2, characterized in that the attachment between said upper portion and lower portion at said peripheral edges of said second and third large lower and upper orifices, is achieved by screwing with a threaded clamping bracket cooperating with an outer peripheral threading of the peripheral edge of said third large upper orifice, and the orientation of both of said upper portion and lower portion of the pre-filter body relatively to each other is adjustable in rotation relatively to each other according to any position.

9. The pump hydraulic portion body according to claim 2, characterized in that said attachment between said upper portion and lower portion, at said peripheral edges of said second and third large lower and upper orifices, is achieved by a plurality of bolts and screws cooperating with a plurality of orifices, regularly distributed in said peripheral edges of said second and third large orifices.

10. The pump hydraulic portion body according to claim 9, characterized in that said orifices are small circular orifices capable of receiving a so-called screw and the orientation of one of both of said upper portion and lower portion of the pre-filter body, relatively to the other portion, being adjustable in rotation according to a limited number of positions, corresponding to the number of said small orifices of each peripheral edge.

11. The pump hydraulic portion body according to claim 10, characterized in that said orifices are slots along a circular arc direction over a portion of said circular peripheral edges, said slots extending over an angular sector.

12. The pump hydraulic portion body according to claim 1, characterized in that:

said upper portion comprises a tubular wall with an at least partly circular section opening out at its upper and lower end onto said first large upper orifice and said second large lower orifice, and said lower portion comprises a tubular peripheral wall; with a same at least partly circular section, the upper end of which opens onto said third large upper orifice, the lower end of said tubular peripheral wall of said receptacle corresponding to the bottom of said receptacle.

13. The pump hydraulic portion body according to claim 12, characterized in that said upper portion comprises a tubular wall with a partly circular section, comprising two diametrically opposite flats at the attachment components of said lid.

14. A swimming pool pumping and pre-filtration device comprising an electric motor mounted in a removable attachment with a so-called turbine casing body cooperating with a hydraulic pump hydraulic portion body according to claim 1.

15. A swimming pool pumping and pre-filtration device comprising an electric motor mounted in a removable attachment with a so-called turbine casing body forming a same one-piece part in continuity with said lower portion of a hydraulic pump hydraulic portion body according to claim 1.

16. The pump hydraulic portion body according to claim 1, characterized in that the said limited number of positions is of at least 3 to 12 positions.

* * * * *